United States Patent [19]

Niemi

[11] Patent Number: 4,850,738

[45] Date of Patent: Jul. 25, 1989

[54] ROADWAY MAT AND METHODS FOR ITS CONSTRUCTION

[76] Inventor: Monte Niemi, 13012 Eldorado St. NE., Blaine, Minn. 55434

[21] Appl. No.: 150,054

[22] Filed: Jan. 29, 1988

[51] Int. Cl.[4] ..... E01C 3/00

[52] U.S. Cl. ..... 404/31; 404/82

[58] Field of Search ..... 404/2, 32, 33, 35, 40, 404/82; 405/15, 16, 19, 50; 210/170; 428/323

[56] References Cited

U.S. PATENT DOCUMENTS

| | | | |
|---|---|---|---|
| 2,977,864 | 4/1961 | Pullar | 404/32 X |
| 3,233,414 | 2/1966 | Hansen, Jr. et al. | 405/50 |
| 3,253,521 | 5/1966 | Endres | 404/73 |
| 3,822,955 | 7/1974 | Haferkamp | 404/72 |
| 3,842,806 | 10/1974 | Stiles et al. | 405/19 |
| 3,915,581 | 10/1975 | Copp, Jr. | 404/32 |
| 3,928,701 | 12/1975 | Roehner | 428/222 |
| 3,990,247 | 11/1976 | Palmer | 405/16 |
| 4,073,753 | 2/1978 | Hauge | 404/32 X |
| 4,074,948 | 2/1978 | Heater | 404/75 |
| 4,139,319 | 2/1979 | Anderson | 405/16 |
| 4,142,821 | 3/1979 | Doring | 405/258 |
| 4,168,924 | 9/1979 | Draper | 404/70 |
| 4,196,694 | 4/1980 | Buchanan | 405/16 |
| 4,564,310 | 1/1986 | Thelen et al. | 404/32 X |

FOREIGN PATENT DOCUMENTS

| | | | |
|---|---|---|---|
| 2655729 | 12/1976 | Fed. Rep. of Germany | 404/32 |
| 203928 | 11/1983 | German Democratic Rep. | 404/32 |
| 4446 | 1/1980 | Japan | 405/16 |
| 9924 | 1/1980 | Japan | 405/16 |
| 1712 | 1/1986 | Japan | 405/16 |
| 7706564 | 12/1978 | Netherlands | 405/19 |
| 684096 | 9/1979 | U.S.S.R. | 405/16 |
| 1108158 | 8/1984 | U.S.S.R. | 405/15 |
| 1110855 | 8/1984 | U.S.S.R. | 405/15 |
| 435324 | 9/1935 | United Kingdom | 404/32 |

OTHER PUBLICATIONS

"PM-6 Constructing Access Roads with MIRAFI® 140 Fabric 9/75 by Celanese Fibers Marketing Company".

"Slope Saver" by Lafayette Farm and Industry, 9308 CTH. H.

"Fabrics Provide Missing Link in Forest Road Construction, Logging Management, 4/81".

Photograph, from Feb. 13, 1970 issue of the *Duluth Herald.*

*Primary Examiner*—Jerome W. Massie, IV

*Assistant Examiner*—Gay Spahn

*Attorney, Agent, or Firm*—James R. Haller; Mary P. Bauman

[57] ABSTRACT

A water-draining stable mat is described, made up of tires of portions of tires. The roadway mat has several layers that are borne upon and conform to a substrate of peat, dirt, sand, clay or other soil material. One layer of a roadway mat of the invention is a layer of vehicle tires or toroidal elements of vehicle tires, laying side by side. Each tire touches at least two other tires but no more than four other tires. Contiguous tires are bound together using a toggle strap that straddles the side walls of contiguous tires. Another layer of the roadway mat is made up of cut pieces of vehicle tires called "chips". The layer of chips are applied so that the chips are in overlapping relationship to each other and so that the chips lie generally parallel to the substrate. The tire chips form water seepage channels thus allowing excess water to soak into the substrate. Another layer is a layer of topping. The topping comprises sand, gravel, dirt and/or other material commonly used in road building. This layer is applied to and completely covering the other two layers described above.

15 Claims, 3 Drawing Sheets

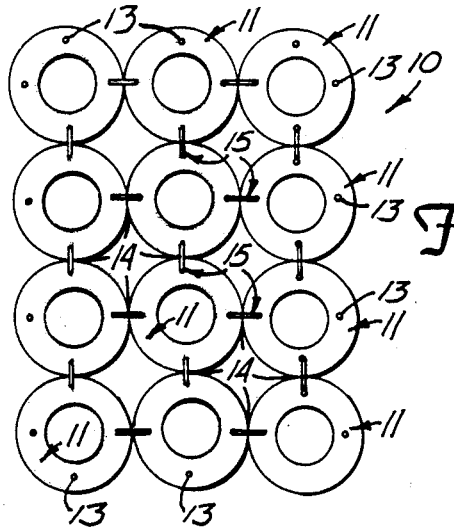
Fig. 1
Fig. 2
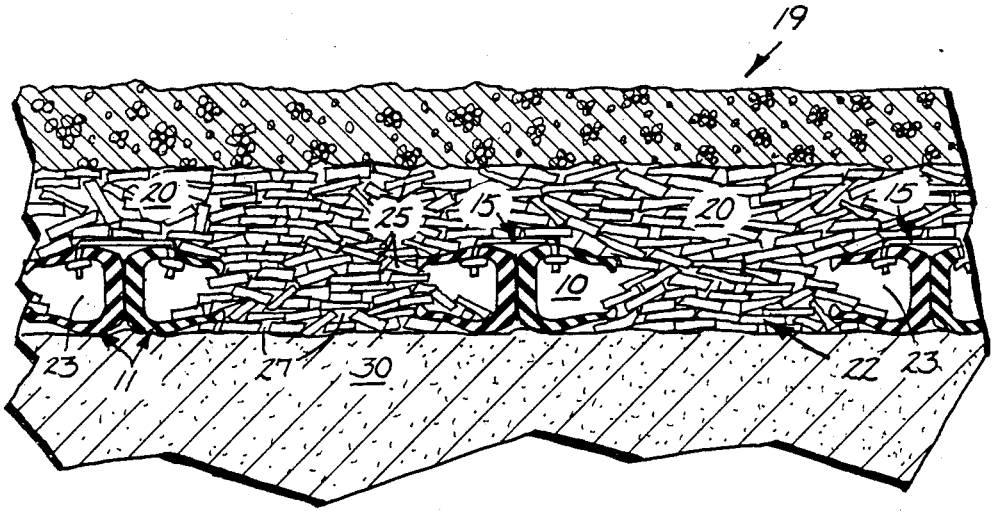

Fig.6
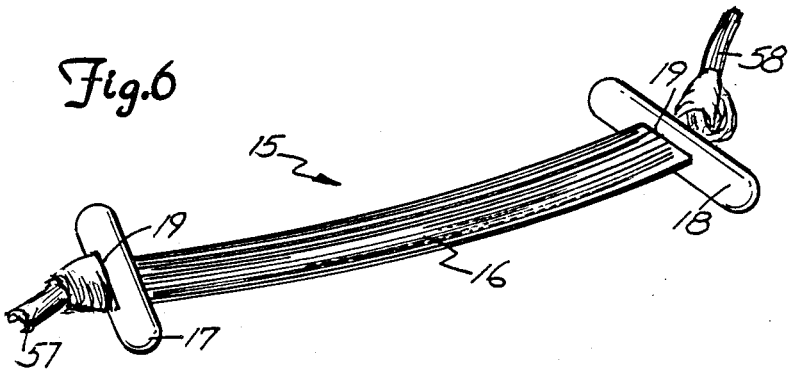
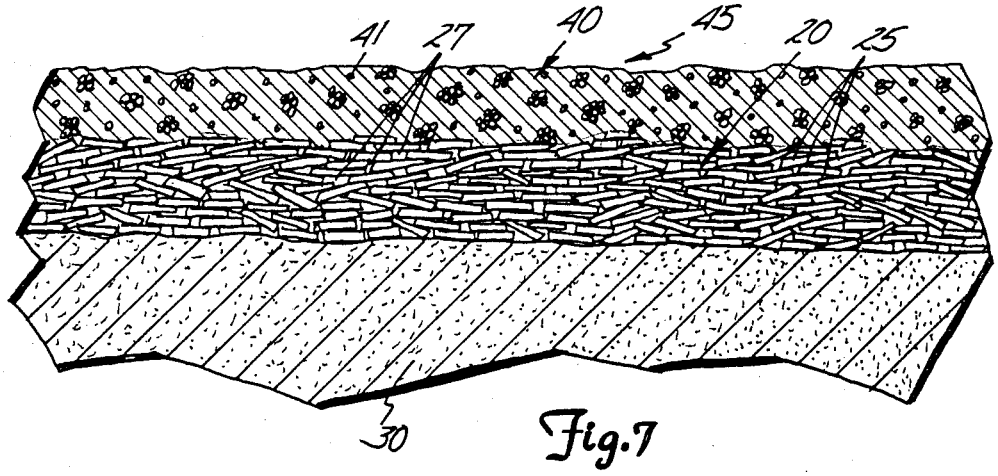
Fig.7
Fig.8
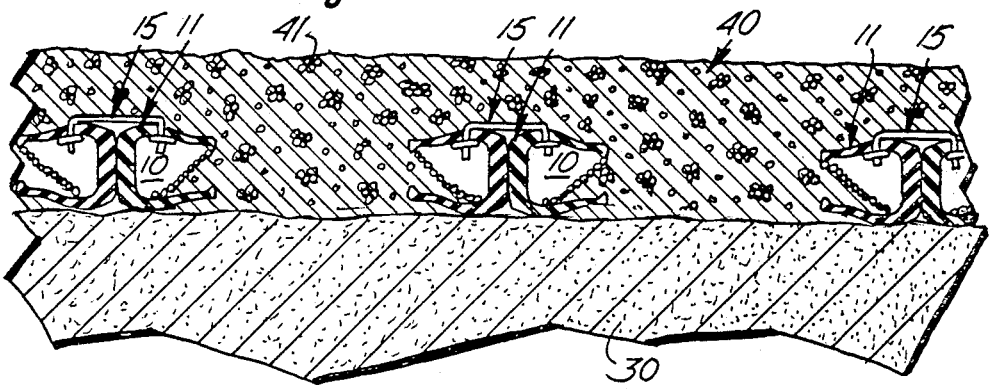

ROADWAY MAT AND METHODS FOR ITS CONSTRUCTION

FIELD OF THE INVENTION

This invention relates to a roadway mat and methods of constructing same. The invention relates more particularly to a roadway mat comprising vehicle tires or portions of vehicle tires.

BACKGROUND OF THE INVENTION

A common method for making a road in a rural area involves preparing a surface by clearing or grading the underlying dirt, peat, or clay subsoil into a roadbed, and then applying a layer of gravel to the prepared surface to form the roadway surface.

This method of road construction does not work well in marshy or wet areas. Greater amounts of gravel must be applied to the surface to provide a roadway of desired firmness, and the road's use life is very short in such areas. As the roads are driven upon by motor vehicles, some of the gravel is displaced to the outside of the road. Other gravel is embedded by the weight of the vehicles into the subsoil. The embedding process occurs more quickly when the subsoil is wet. As time passes the gravel becomes so deeply embedded in spots that patches of the subsoil appear on the road surface. This process is commonly referred to as "mixing". These patches become very muddy during rainstorms and soon holes or ruts in the road appear where the gravel has been worn away and/or deeply embedded.

An asphalt layer is sometimes applied over the gravel surface of the road to prevent slippage of the gravel and to lengthen the life of the road. The gravel, however, is still able to embed into the subsoil, and this may lead to cracks in the asphalt and to the appearance of potholes which require prompt repair.

SUMMARY OF THE INVENTION

This invention relates to a water-draining, stable roadway mat and methods for its construction from scrap vehicle tires or portions of vehicle tires. A water-draining stable roadway mat is constructed comprising a plurality of layers borne upon a roadway substrate and conforming to the substrate. In one embodiment, one layer comprises a plurality of generally coplanar annular vehicle tire elements, and binding means binding contiguous tire elements together. A different layer comprises a plurality of vehicle tire "chips" that is, generally flat or slightly rounded or domed tire pieces, in overlapping relationship with one another, the chips being generally parallel to the substrate and cooperating to form a plurality of water seepage channels. A third layer comprises a conventional topping such as gravel completely covering the layer of annular elements and the layer of tire chips.

In another embodiment the roadway mat comprises a tire layer formed of a plurality of generally coplanar vehicle tire elements bound together and a layer of conventional topping upon and covering the tire elements and having a thickness of at least about twice the height of the tire layer borne upon the substrate.

In yet another embodiment of the invention, the roadway mat comprises a layer of a plurality of tire chips in overlapping relationship to one another and cooperating to form a plurality of water seepage channels and a layer of topping upon and completely covering the layer of chips. The layers are borne upon and conform to a roadway substrate, as mentioned above.

Yet another embodiment is a method of constructing a water-draining stable roadway mat employing a plurality of layers borne upon and conforming to a substrate. The method comprises forming, as contiguous layers upon and conforming to a roadway substrate, a layer of a plurality of generally coplanar annular vehicle tire elements and binders binding contiguous tire elements together and a layer comprising a plurality of vehicle tire chips in overlapping relationship with one another, the chips being generally parallel to the substrate and cooperating to form a plurality of water seepage channels. Topping is provided to cover the aforementioned layers.

Another embodiment is a method comprising the steps of applying a layer of a plurality of vehicle tire chips to a substrate in overlapping relationship to one another and cooperating to form a plurality of water seepage channels, the chips being generally parallel to the substrate. A layer of topping is applied upon and completely covering the layer of tire chips.

Another method of the invention comprises the steps of providing a roadway substrate by clearing or grading a surface to form a substrate, layering upon the substrate a plurality of coplanar annular tire elements that are vehicle tires or toroidal portions thereof and that conform to the substrate. A plurality of tire chips are applied in overlapping relationship to one another, said chips cooperating to form a plurality of water seepage channels upon and covering the layer of tire elements, the chips lying generally parallel to the substrate. A layer of topping is then applied over and completely covering the layer of tire chips.

In another embodiment is a method in which a layer of a plurality of tire chips is applied to the substrate, a layer of a plurality of coplanar annular elements is applied upon and covers the layer of tire chips and a third layer of topping is applied upon and covers the layer of coplanar annular elements.

BRIEF DESCRIPTION OF THE DRAWING

FIG. 1 is a broken-away plan view of a layer of tires joined in accordance with the invention;

FIG. 2 is a broken-away cross-sectional view of a portion of a roadway mat of the invention shown in place on a substrate;

FIG. 6 is a perspective view depicting a binder means that can be used in conjunction with the roadway mat of this invention;

FIG. 7 is a broken-away cross-sectional view of a roadway mat of a modified embodiment of the invention shown in place on a substrate.

FIG. 8 is a broken-away cross-sectional view of a roadway mat of a modified embodiment of the invention.

DETAILED DESCRIPTION OF THE PREFERRED EMBODIMENTS

Figure 3:
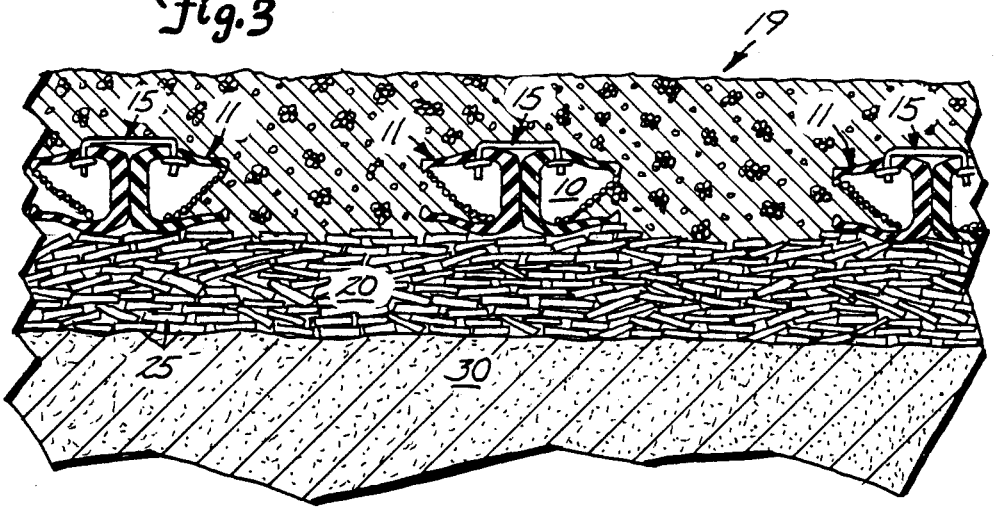
FIG. 3 is a broken-away cross-sectional view of a portion of a roadway mat of the invention shown in place on a substrate.

The invention provides a water-draining, stable roadway mat that increases the use life of roadway surfaces covering substrates of dirt, peat, silt, clay, sand or other natural material. The preferred embodiments of the invention is illustrated in FIGS. 1 through 8.

FIG. 1 depicts a plan view of a layer (10) of a roadway mat comprising a plurality of generally coplanar annular tire elements (11) which are vehicle tires or toroidal portions of vehicle tires as may be made by cutting a tire circumferentially of its large diameter to form a pair of mirror-image tire halves. Contiguous elements in the layer are bound together by binding means (15). Desirably the layer comprise a plurality of automobile tires because automobile tires are generally of a fairly uniform size. However, other vehicle tires such as truck or tractor tires, may be used. The thickness of the layer, that is, the height of the layer, will be determined by the height of the toroidal portions of tires so used.

Contiguous tire elements of the layer are bound together at or adjacent their points of tangency (14), preferably at 90° angles from the tire axes. That is, the tire elements preferably are arranged so that no tire touches more than four adjacent tires. The layer must be flexible enough to conform to road substrate contours and yet strong enough to withstand horizontal spreading forces. The tire elements may be fastened together in sections and then placed on the substrate, or the tire elements may be laid on the substrate and then fastened or bound to one another. Each tire element is bound to at least two other tire elements. The majority of tire to-tire intersections are provided with a binder (15). Preferably at least about 65% of the tire intersections are so bound. The tire layer, by providing at least some spacing between the layer of topping such as gravel and the substrate, operates to restrain the embedding or mixing of the topping into the substrate of dirt, peat, sand, clay or other natural material. "Conventional topping" refers to sand, gravel, stones and the like, as may be available.

FIG. 2 and FIG. 3 show cross-sectional broken-away views of a portion of a roadway mat of the invention. In FIG. 2, a layer (10) of vehicle tires and, completely covering that layer, a layer (20) of a plurality of tire chips (25) spread in overlapping relationship to each other upon the tires (11), are layered over a substrate (30) of dirt, peat, sand, clay or other natural material. The chips (25) are positioned for the most part generally parallel to the substrate (30) and cooperate to form water seepage channels (27). The layer of chips (25) fill the open center section (22) of the tires (11) or toroidal portions thereof, thereby completely covering the layer (10) of tires. The hollow annular portions (23) of the vehicle tires may be left at least partially unfilled.

FIG. 3 shows a roadway mat in which a layer (20) of a plurality of tire chips (25) are layered upon and conform to a substrate (30) and upon the layer (10) of chips is a layer of a plurality of generally coplanar annular tire elements (11) such as vehicle tires or toroidal portions thereof.

Figure 4:
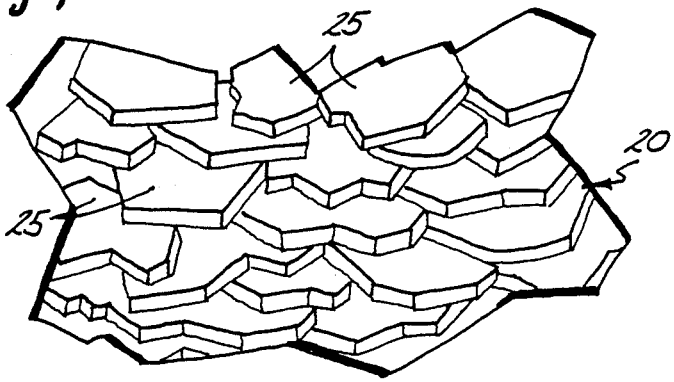
FIG. 4 is a perspective view of the upper portion of the mat portion shown in FIG. 2.

In FIG. 4 a cross-sectional view of the layer (20) of chips (25) is shown. "Chips (25)", as referred to herein, are provided from vehicle tires to form generally flat or slightly domed pieces. The pieces are often generally rectangular in shape. The majority of chips (25) formed in the shredding process have surface areas ranging from about 5 $in^2$ (13 $cm^2$) to about 50 $in^2$ (127 $cm^2$) Desirably the chips (25) used to make up a layer of the roadway mat range in dimensions from about 3 inches (7.6 cm) to about 6 inches (15 cm) and have surface areas approximately 9 $in^2$ (23 $cm^2$) to 36 $inches^2$ (91 $cm^2$) The layer (20) of tire chips desirably ranges from about one to two feet (0.3 to 0.6 meters) in depth measuring, upwardly from the top of the layer the chips cover. For example, if the layer (20) of chips covers a layer (10) of tires, the depth is measured from the top surface of the tire layer (10). The frictional forces between adjacent chips tend to restrain them from separating laterally out towards the edges of the road in response to downwardly directed forces resulting from the weight of vehicles upon the roadway. The layer (20) of tire chips by providing at least some spacing between a topping and the substrate, operates to restrain embedding or mixing of the topping into the substrate.

Figure 5:
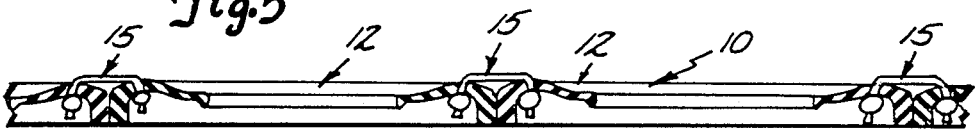
FIG. 5 is a broken-away cross-sectional view of a portion of a modified embodiment of the invention.

FIG. 5 shows a broken-away cross-sectional view of a roadway mat of the invention. The layer (10) of coplanar annular elements in this embodiment comprise toroidal portions (12) of vehicle tires. Toroidal tire sections (12) can be made by forming a through-cut circumferentially of a tire carcass. The toroidal tire sections (12) in a layer (10) may be bound together concave upwardly or concave downwardly.

FIG. 6 shows one means for binding the contiguous elements together in the layer (10) of tires. The binding means (15) is desirably a strap (16) of a material that is flexible yet durable and resistant to deterioration by micro-organisms. On the ends (57, 58) of the strap are toggles (17, 18). In one embodiment the strap (16) is made of a web of parallel nylon fibers and on each end are toggles formed of plastic rods (17, 18) having slits (19) through which strap ends are threaded. The strap (16) should fit snugly through the slit (19) in the toggle (17) or (18). The outer end (57) or (58) of the strap may be knotted after it has been threaded through the rod to prevent the toggle (17, 18) from slipping off of the strap (16). Other means such as clips on the strap may be used to prevent the toggle from sliding from the strap.

The tire elements (11) as shown in FIG. 1 have four holes (13) punched into the center of the sidewall at 90° angles from each other. When the tires are laid together the hole (13) of one tire (11) is matched with the hole (13) of the contiguous tire (11). The toggle end (57, 58) of the strap is inserted into the matching holes, thus binding the two tires together.

Other binding means (15) may be used including, for example, rivets inserted between treads of contiguous tires or a strap releasably fastened around the perimeters of the tire elements to hold adjacent tires securely together. The binding means must restrain the tires from spreading laterally out towards the edges of the road in response to downwardly directed forces resulting from the weight of the vehicles upon the roadway.

FIG. 7 shows another embodiment of the invention. The roadway mat (45) shown in FIG. 7 comprises a plurality of layers borne upon a substrate (30). The substrate (30) is the surface of a cleared predetermined pathway. The surface should be cleared of large obstacles and tree stumps. Desirably the clearing process leaves grass or other plant life growing on the surface undisturbed. The roadway mat (45) is placed upon the substrate (30) and conforms thereto. One layer (20) of the mat comprises a plurality of tire chips (25) in overlapping relationship to one another, the chips (25) being generally parallel to the substrate (30) and cooperating to form water-seepage channels (27). Another layer (40) of topping (41) lies upon and covers the other layers on top of the substrate (30).

The layer (40) of topping (41) is preferably a particulate solid such as a finely divided aggregate, gravel, stone or coarsely divided aggregate of a type used in building roads. The topping (41) may comprise a mixture of materials or layers of materials. The layer (40) may have a depth of approximately one to three feet. The topping (41) may include 8–10 inches of gravel at the top that forms the surface of the road.

FIG. 8 shows a portion of another embodiment of a roadway mat of this invention comprising a plurality of layers borne upon a substrate (30). One layer (10) is a plurality of coplanar annular elements (11) which are vehicle tires or toroidal portions thereof. Contiguous tires (11) are bound to each other by binding means (15). Tires (11) are bound at 90° angles from the center of the tire at the place where they are tangentially connect. Upon and covering the layer (10) of tires (11) is a layer (40) of topping (41) such as dirt, sand or gravel.

An embodiment of this invention is a method for constructing a water-draining roadway mat such as that shown in FIGS. 2, 3, 7 or 8. One method comprises clearing or grading a surface to form a substrate (30). In swampy or marshy areas, only large obstacles such as tree stumps and the like are removed. The vegetation and other materials lying upon the surface are left relatively undisturbed to provide some additional structure to the subsoil in those areas.

Once a substrate (30) has been prepared, layers of material may be applied thereto. As shown in FIG. 2, a layer (10) of a plurality of tire elements (11) is applied first. This layer (10) may be preformed, stored on a large roller and then transported to the site by truck. To form the layer (10), tire elements (11) are laid side-by-side, preferably so that each tire (11) will be in tangential contact with at least two other tires (11) and at least no more than four other tires (11). Before the tire elements (11) are laid on the surface to form a layer, four holes (13) are formed in the sidewall of each tire element, preferably at 90° angles from the tire axes. Once the layer (10) has been formed, contiguous elements (11) are bound together by toggle straps (15) such as the strap shown in FIG. 6.

The toggle straps (15) are attached to the respective tire elements (11) by positioning the toggle (17) or (18) vertically with respect to the strap (16) and inserting it through a hole in the sidewall (51) of one tire (11) and then permitting the toggle (17) or (18) to move from its vertical position to a horizontal position so that it will be prevented from withdrawing from the hole (13). Sometimes a gun-like instrument is used to shoot the toggle (17) or (18) through the hole (13). Then the toggle (17) or (18) on the opposite end of the strap (16) is positioned vertically with respect to the strap (16) and inserted into the hole (13) in the adjacent tire (11). After the tires (11) have been bound together to complete the layer (10), the preformed layer may be transported to the road site and applied to the substrate (30) in sections.

The layer (10) may also be constructed at the road site. Desirably a team of two work together to construct the layer (10). One team member lays the tire elements (11) on the substrate (30) so that each element (11) tangentially touches at least two other tire elements (11) and no more than four other tire elements (11), making certain that the sidewall holes (13) in contiguous tire elements (11) match up. The second team member binds the tire elements (11) together by inserting toggles (17) and (18) into the sidewall holes (13) of the contiguous tire elements (11).

The toggle straps (16) are not used every point of tangential contact between tire elements (11). Only 65% of the points of contact are bound together. The binding prevents the tire elements (11) from spreading in a horizontal direction and also from flipping on an end as pressure is asserted to one side of the tire.

Worn-out tires have always presented society with a disposal problem. They are constructed in such a way that a few years after they have been buried at waste disposal sites, they tend to rise to the surface. In order to prevent such "unearthing" of the tires used in this invention, the tire elements are bound to each other.

In other methods of the invention, after the layer of tire elements (11) has been applied, a layer (20) of a plurality of tire chips (25) is supplied. These tire chips (25) are handled in much the same way dirt and gravel are handled in road building. The chips (25) may be transported to the road site in a truck and dumped onto the surface. The chips may then be bladed into a (20) layer using an earth mover blade.

After the layer (20) of chips (25) has been applied to the layer (10) of tire elements (11), a layer (40) of topping (41) is applied. When a road is being built in a swampy or marshy area, topping (41) may include dirt, vegetation, sticks and stones taken from a nearby field that has a firmer subsoil than the area in which the road is being built. When this is done, the topping is referred to as "borrow" because it was borrowed from one area for use in a new area. The topping may include several layers of particulate materials. As gravel commonly must be brought to the road building site, it is more expensive to use as topping than "borrow". Gravel, however, makes a better road surface. For this reason, the first portion of the topping (41) may be made up of borrow with several inches of gravel being placed on the top to form the road surface. Other embodiments of the invention include methods of constructing a roadway mat that are similar to those described above but in which the layers are applied in a different order or one of the layers mentioned above are omitted from the roadway mat.

While a preferred embodiment of the present invention has been described, it should be understood that various changes, adaptations and modifications may be made therein without departing from the spirit of the invention and the scope of the appended claims.

What is claimed is:

1. A water-draining, stable roadway mat comprising:

a plurality of layers adapted to be borne by a substrate and to conform thereto;

one layer comprising a plurality of generally coplanar annular vehicle tire elements or toroidal portions thereof and binding means binding contiguous elements together;

a different layer comprising a plurality of generally flat or slightly domed tire chips in overlapping relationship to one another, the chips being generally parallel to the substrate and cooperating to form a plurality of water seepage channels; and a third layer comprising topping upon and completely covering the aforementioned layers.

2. The mat of claim 1 wherein the layer of annular vehicle tire elements lies directly upon the substrate and is covered by the layer of tire chips.

3. The mat of claim 1 wherein the layer of tire chips lies directly upon the substrate and is covered by the layer of annular tire element.

4. The mat of claim 1 wherein the layer of topping is approximately twice the height of the layer of annular tire elements.

5. A method of providing a roadway with a water-draining stable mat comprising:

applying to a substrate a layer of a plurality of generally coplanar annular elements which are vehicle tires or toroidal portions thereof having contiguous elements bound together;

applying to a substrate a different layer comprising a plurality of generally flat or slightly domed tire chips in overlapping relationship to one another, and cooperating to form a plurality of water seepage channels upon and conforming to the substrate, the chips being generally parallel to the substrate and applying a third layer comprising a topping upon and completely covering the above-mentioned layers.

6. The method of claim 5 wherein the layer of annular elements is applied to the substrate in a first step and then a layer of tire chips is applied upon and covering the layer of annular elements.

7. The method of claim 5 wherein the layer of tire chips is applied to the substrate in a first step and the layer of annular elements is applied upon and covering the layer of tire chips.

8. A water-draining, stable roadway mat comprising a plurality of layers adapted to be borne by a substrate and to conform thereto, one of said layers comprising a plurality of generally flat or doomed shape tire chips in overlapping relationship with one another and being generally parallel to the substrate, the chips having areas ranging from about 5 square inches to about 50 square inches and cooperating to form a plurality of water seepage channels.

9. The water-draining, stable roadway mat of claim 8 including a topping layer upon and completely covering the layer of tire chips.

10. The water-draining, stable roadway mat of claim 8 wherein the layer of tire chips is in the range of about 1 to about 2 feet in thickness.

11. The water-draining, stable roadway mat of claim 8 in which the chips have dimensions generally falling in the range of about 3 to about 6 inches.

12. A water-draining, stable roadway mat comprising a plurality of layers adapted to be borne by a substrate and to conform thereto; one layer comprising a plurality of tire chips having areas ranging from about 5 square inches to about 50 square inches and lying in overlapping relationship with one another and generally parallel to the substrate, the chips cooperating to form a plurality of water seepage channels and forming a layer ranging form about 1 to about 2 feet in thickness; and another layer disposed upon and completely covering the layer of tire chips.

13. A method of providing a roadway with a water-draining, stable mat, characterized by including the step of applying to a substrate a layer comprising a plurality of tire chips having areas ranging from about 5 square inches to about 50 square inches, the tire chips lying in overlapping relationship to one another generally parallel to the substrate and cooperating to form a plurality of water seepage channels therebetween.

14. The method of claim 13 including the step of applying a different layer upon and completely covering the layer of tire chips.

15. The method of claim 14 wherein the tire chip layer is applied to a thickness of about 1 to about 2 feet.

* * * * *